United States Patent [19]

Benjamin

[11] 4,027,634

[45] June 7, 1977

[54] VACUUM BREAK ASSEMBLY

[75] Inventor: Benjamin C. Benjamin, Flint, Mich.

[73] Assignee: Schmelzer Corporation, Durand, Mich.

[22] Filed: Aug. 27, 1975

[21] Appl. No.: 608,102

[52] U.S. Cl. ..... 123/119 F; 261/39 B

[51] Int. Cl.[2] ..... F02M 1/10; F02M 1/08

[58] Field of Search ..... 123/119 F, 117 A; 261/39 B

[56] References Cited

UNITED STATES PATENTS

| | | | |
|---|---|---|---|
| 3,773,023 | 11/1973 | Taylor | 123/119 F |
| 3,800,762 | 4/1974 | McCullough | 123/119 F |
| 3,831,567 | 8/1974 | Freismuth et al. | 123/119 F |
| 3,886,241 | 5/1975 | Schubeck | 123/119 F X |

*Primary Examiner*—Wendell E. Burns
*Attorney, Agent, or Firm*—Fisher, Gerhardt & Groh

[57] ABSTRACT

A vacuum break assembly for the carburetor of an internal combustion engine that acts in connection with a thermostatic controlled control to permit the carburetor choke valve to be closed during starting but provides a controlled gradual opening of the choke valve after starting. The device includes a valve with a precision bypass which is protected from clogging by a filter element encapsulated by a member which also forms a part of the valve seat.

8 Claims, 3 Drawing Figures

VACUUM BREAK ASSEMBLY

The present invention relates to vacuum break devices for the choke valve on carburetors on internal combustion engines.

Vacuum break devices which are used with the carburetors of internal combustion engines are used to vary the setting of the choke valve in response to manifold vacuum pressure in a manner such that as vacuum pressure increases, the choke valve is opened. Such arrangements sometimes employ a one way check valve which in its closed position permits restricted air flow and consequently delayed operation of the vacuum break device. It is very important that the check valve and the restrictive passage remain clean and as a consequence filter elements are often provided. The entire vacuum break device is usually mounted on the carburetor itself and because of the restrictions and space in the engine compartment it is important the the vacuum break unit be small in size. It therefore becomes important that the device remains very simple with a minimum number of parts to facilitate not only the manufacture of the device, but also its trouble free operation.

It is an object of the invention to provide a vacuum break device for the choke valve of an internal combustion engine carburetor in which the various ports serve dual functions thereby minimizing the number of ports required.

Figure 1:
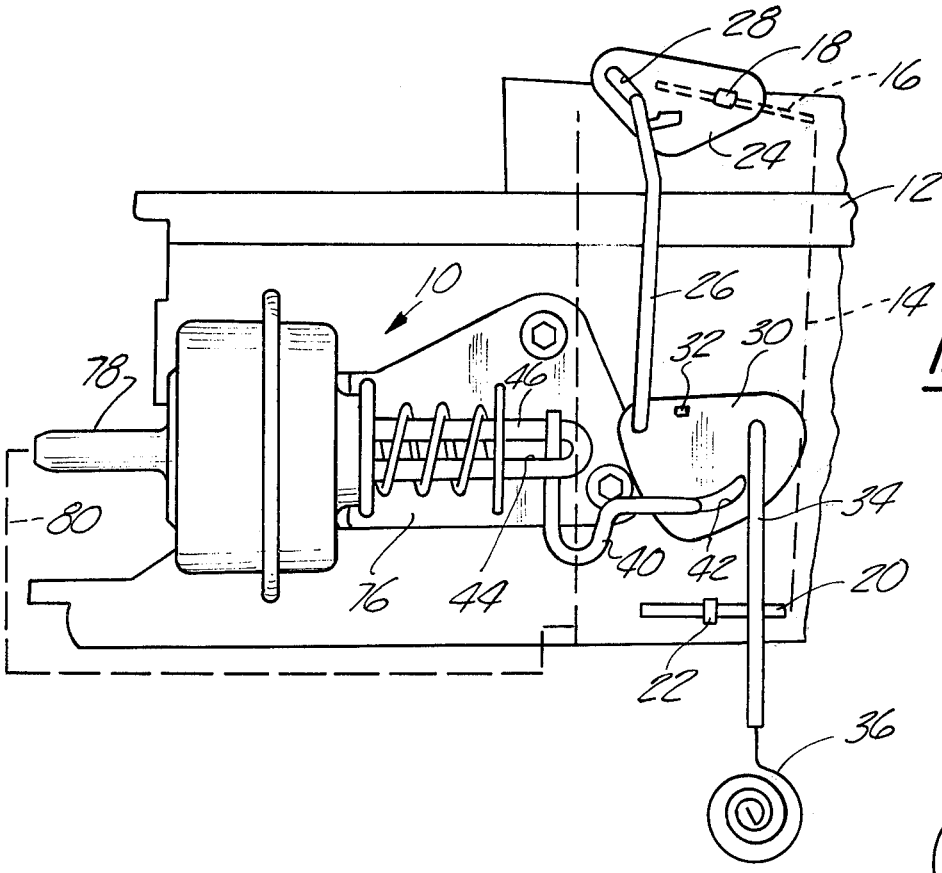
FIG. 1 is a side elevational view of a portion of a carburetor equipped with the vacuum break assembly embodying the invention.
Figure 3:
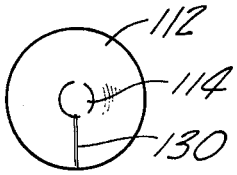
FIG. 3 is a view of a valve element of the vacuum break assembly seen in FIG. 2.

Referring to the drawings, a vacuum break device 10 embodying the invention is shown mounted on a carburetor indicated at 12. The carburetor 12 has fuel induction passage 14, the upper end of which is provided with a choke valve 16 rotatable about the axis of a shaft 18. The lower end of the induction passage 14 is controlled by a throttle valve 20 which rotates about the axis of the shaft 22.

The choke shaft 18 supports a lever member 24 at the exterior of the carburetor which is connected to a link 26 having one end received in a slot 28 in the lever 24 and its other end received in an opening in an intermediate lever 30 pivotally mounted by a shaft 32 to the carburetor 12. The intermediate lever 30 is connected by means of a link 34 to a thermostatic coil device 36. Upon an increase in temperature the thermostatic coil device 36 moves the link 34 downwardly and the link 26 upwardly to rotate the choke valve 16 from its closed position in which it is shown in the drawings, toward an open position.

The intermediate lever 30 is also connected to the vacuum break device 10 by means of a link 40 having one end connected in a slot 42 in the intermediate link 30 and its other end disposed in a slot 44 formed by a stem 46 which is a part of the vacuum break device 10.

Figure 2:
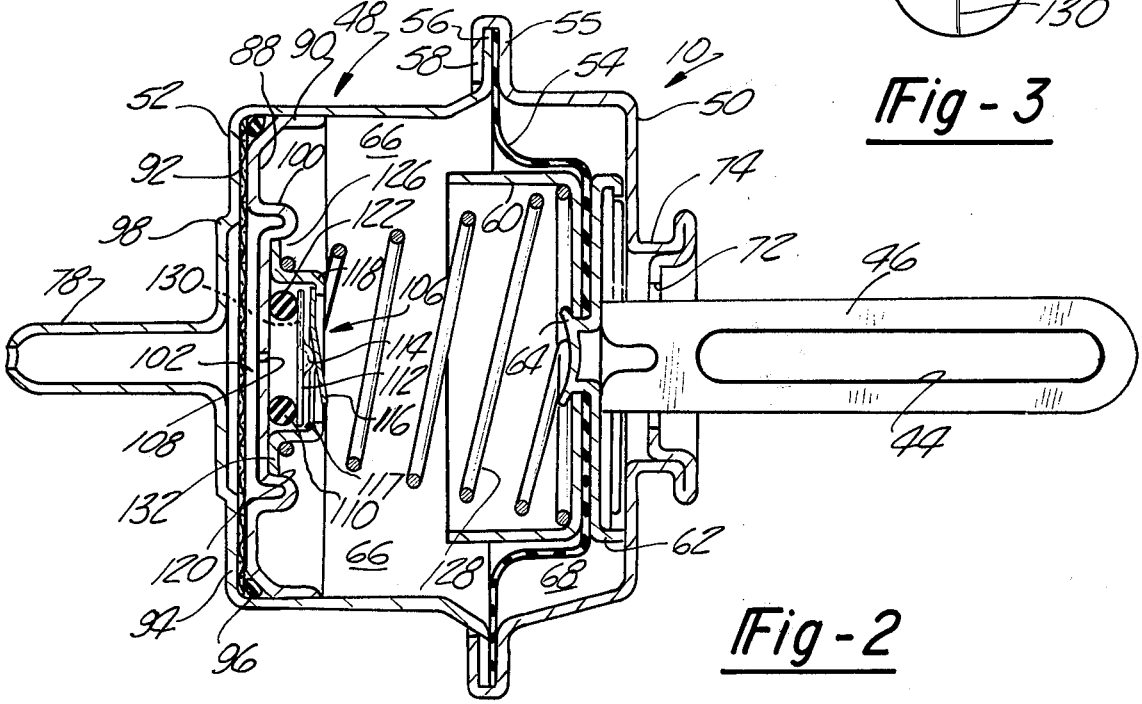
FIG. 2 is an enlarged sectional view of the vacuum break assembly seen in FIG. 1.

As seen in FIG. 2, the vacuum break device 10 includes a housing 48 formed of a pair of cup shaped elements 50 and 52. A diaphragm 54 has its outer circumferential edge clamped between flanges 55 and 56 of the cup shaped members 50 and 52 respectively. The members 52 and 54 are held together in fixed relationship by folding over a portion 58 of the flange 55 around the flange 56.

Opposite sides of the diaphragm 54 are engaged by a cup shaped member 60 and an oppositely facing cup shaped member 62. The members 60 and 62 are held in engagement with opposite sides of the diaphragm by the flattened end 64 of the stem 46 which passes through aligned openings in the cup shaped elements 60 and 62 and in the diaphragm 54. The cup shaped elements 60 and 62 act as stop elements to limit the extent of movement of the diaphragm assembly formed by the diaphragm 54 and the cup shaped elements 60 and 62.

The diaphragm 54 serves to divide the housing 48 into a control chamber 66 and an atmospheric chamber 68 at opposite sides of the diaphragm 54. The stem 46 which is attached to the diaphragm assembly passes through an enlarged opening 72 serves to maintain the chamber 68 at atmospheric or ambient air pressure.

The housing member 50 also forms a annular slot 74 exterior of the housing 58 which is adapted to be received in an elongated slot of a mounting bracket 76 by which the vacuum break unit may be mounted on the carburetor 12.

The housing member 52 forms an axially extending tubular portion 78 which forms a vacuum inlet by which the vacuum break unit may be connected through a conduit indicated at 80 to the engine intake manifold or to the carburetor 12 downstream of the throttle valve 20.

Disposed within the housing member 52 is a wall member 88 which has an outer circumferential flange 90. A filter element 92 is disposed between the wall member 88 and the end wall 94 of the housing member 52 and is held in position by the circumferential flange 90 in frictional engagement. with the internal diameter of the housing member 52. A large O-ring 96 is disposed between the filter element 92 and the wall member 88 to provide a fluid tight seal. The end wall 94 is offset as indicated at 98 and the wall member 88 is similarly offset at 100 to form a chamber 102 in which a substantial portion of the filter element 92 is disposed. Air passing through the vacuum inlet tube 78 and entering the chamber 102 for passage through the filter 96 is filtered over a relatively large area. As dirt particles accumulate on the filter element, the large area of the filter affords uncontaminated areas through which the air is free to flow.

Passage of air through the vacuum inlet tube 78 to the control chamber 66 is controlled by a check valve assembly indicated generally at 106. The check valve assembly 106 includes an air passage 108 formed axially of the wall 88 and communicating the filter chamber 102 with the control chamber 66. The valve assembly 106 also includes an O-ring 110 which has one of its faces in engagement with a surface of the wall 88 surrounding the opening 108. A disc like valve element 112 is engageable with the opposite face of the O-ring 110 and is provided with an axial protrusion 114 which is engaged by a leaf spring 116 which is made of mylar or the like and is seated against an inner flange 117 of a retainer element 118. The retainer element 118 is fastened to the wall member 88 in a recess 120 formed in the latter and is permanently held in position in any conventional manner as by welding or staking or the like. The recess 120 and the retainer 118 form a valve cavity 122 which serves to confine the O-ring 110, valve closure element 112 and the spring 116.

The valve element 112 is provided with a radially extending groove 130 which provides a restricted passage for air when the valve element 112 is seated on O-ring 110.

A portion of the recess 120 in the wall member 88 and an outer flange 132 of the retainer member 118 form an annular groove 126 receiving one end of a coil spring 128 which has its opposite ends seated within the cup shaped member 60 forming part of the diaphragm assembly.

In operation, when an internal combustion engine is to be started, the choke valve 16 is in its closed position as shown in FIG. 1 and is held in its closed position by the thermostatic coil 36 which urges the link 34 upwardly and the link 26 downwardly. This restricts air flow through the carburetor to provide a rich starting mixture. After the engine has started, manifold vacuum pressure is available through the hose 80 and tubular portion 78 to the filter chamber 102. The existence of vacuum pressure in the filter chamber 102, causes the control chamber 66 to be evacuated of air which flows through the restricted passage 130 formed between the vlave closure element 112 and the O-ring 110 so that gradually, over a period of several seconds, vacuum pressure also is established in the control chamber 66. Vacuum pressure in the control chamber 66 causes a differential pressure to act on the diaphragm assembly 54 due to the atmospheric pressure in chamber 68 causing the diaphragm assembly 54 to be moved to the left, as viewed in FIG. 2. Movement of the diaphragm assembly causes similar movement of the stem 46 which pulls the link 40 to the left and rotates the lever 30 in a clockwise direction toward an open position. The time required for the diaphragm assembly to move the full distance of its stroke is normally between one and one-half to three seconds, which is a sufficient time to gradually open the choke 16 to obtain the leaner mixture required for smooth operation of the internal combustion engine and which reduces emissions and at the same time prevents engine loading and stalling.

When the engine is stopped, the pressure in the intake manifold or in the tube 80 increases to the pressure of atmospheric air. A pressure differential is created across the valve closure element 112 due to the vacuum pressure existing in the control chamber 66. This causes the valve closure 112 to lift from the 0-ring 110 creating an enlarged opening by which the pressures in the control chambers 66 and in the conduit 82 are rapidly equalized. This enables the spring 128 to bias the diaphragm assembly 54 to its original position as shown in FIG. 2. Such movement permits the choke valve to be moved to a position dependent solely on the force of the thermostatic coil unit 36.

It will be noted that the various components such as the housing member 50 and 52, the wall member 88 and the retainer element 118 can be easily formed of stamped sheet metal and that the various parts serve dual functions. By way of example, the housing element 50 incorporates integrally therewith, the tubular vacuum intake tube 78 and also serves to form a wall portion of the filter cavity 102. The wall member 88 similarly performs the multiple function of forming portions of the filter cavity 102, acts to support the filter 92 in position with the housing 48 and forms the opening 108 which acts as part of the valve assembly. Also the wall member 88 forms a surface for sealingly engaging the O-ring 110 and to support the valve retainer 116. The valve retainer 118 acts not only to encapsulate the moving parts of the valve assembly, but also acts as a spring seat for the spring 116 and forms the annular groove 120 which acts to seat the diaphragm return spring 128. This arrangement of parts makes for a compact trouble free unit and a simplified construction avoiding the use of screw machine parts and the like which are relatively expensive. Moreover, the simplicity of the construction is particularly important because of the relatively small size of the device, which in actual use has a diameter usually less than two inches. By making the various components perform a multiplicity of functions, the problems of assembling minute multiple parts is greatly diminished.

A vacuum break unit for controlling the choke valve of a carburetor on an internal combustion engine is provided in which a minimum of parts are so arranged that they form a control chamber, a filter chamber and a valve chamber. The valve chamber contains the moving parts of a valve assembly which permits the free flow of air in one direction and the restrictive flow of air in the opposite direction. Common parts serve to form a portion of the filter cavity within which the filter is disposed to protect the valve from particles of dirt or other material which may be entrained in the air passing through the valve to the control chamber 66.

The embodiments of the invention in which an exclusive property or privilege is claimed are defined as follows:

1. A vacuum break device for use with a carburetor choke of an internal combustion engine comprising: a housing including a pair of cup-shaped elements, a diaphragm disposed in sealing engagement with said cup-shaped elements and forming a control chamber in one of said cup-shaped elements at one side of said diaphragm, a stem connected to the other side of said diaphragm and adapted for connection to said choke for positioning the latter between a closed and open position upon movement of said diaphram, a wall member disposed in engagement with said one cup-shaped element in axially spaced relation to an end wall of said cup shaped element to form a circular filter chamber in said housing having a diameter substantially equal to the internal diameter of said one cup-shaped element, an air filter element disposed in said filter chamber, passage means between said control chamber and said filter chamber and including an opening in said wall member, valve means including an 0-ring having one face in engagement with said wall and surrounding said opening, a valve closure element positioned for engagement with another face of said 0-ring, an annular retaining element supported on said wall and having a smaller diameter than said filter chamber, first resilient means acting between one side of retaining element and said closure element to urge the latter into engagement with said 0-ring, second resilient means acting between the other side of said retaining element and said diaphragm for urging the latter to a choke closed position, and vacuum inlet means communicating with said filter chamber and adapted for connection to a source of vacuum, said valve means being operative in the presence of vacuum pressure in said filter chamber to evacuate fluid from said control chamber at a restricted rate to move said diaphragm in a choke opening direction and being movable out of engagement with said O-ring in the absence of vacuum pressure in said filter chamber for free admission of air to said control chamber for return movement of said diaphragm to a choke closed position.

2. The combination of claim 1 in which said retaining element surrounds said O-ring.

3. The combination of claim 1 in which said closure element forms a restrictive passage between said O-ring and said closure element for admitting air from said filter chamber to said control chamber when said closure element is engaged with said O-ring.

4. The combination of claim 1 in which said wall member forms a portion of said control chamber and said filter chamber.

5. The combination of claim 1 in which said vacuum inlet means includes a tubular element formed integrally with said housing and extending axially thereof.

6. The combination of claim 1 in which said wall member and retaining element form a valve chamber confining said O-ring, closure element and first resilient means.

7. The combination of claim 1 in which said housing is generally cylindrical and in which said filter element extends to the outer perimeter of said housing.

8. The combination of claim 1 in which said wall member and retaining element forms an annular groove and in which said second resilient means is a coil spring, said annular groove receiving one end of said spring.

* * * * *

UNITED STATES PATENT OFFICE

CERTIFICATE OF CORRECTION

Patent No. 4,027,634 Dated June 7, 1977

Inventor(s) Benjamin C. Benjamin

It is certified that error appears in the above-identified patent and that said Letters Patent are hereby corrected as shown below:

Column 2, line 36, after "engagement" the period should be deleted.

Column 3, line 23, "vlave" should read -- valve --.

Signed and Sealed this

*Eighth* Day of *November 1977*

[SEAL]

*Attest:*

RUTH C. MASON
*Attesting Officer*

LUTRELLE F. PARKER
*Acting Commissioner of Patents and Trademarks*